US011806728B1

(12) United States Patent
Carmichael

(10) Patent No.: US 11,806,728 B1
(45) Date of Patent: Nov. 7, 2023

(54) AUTOMATED CATHODE WASHING SYSTEM

(71) Applicant: CAID INDUSTRIES, INC., Tucson, AZ (US)

(72) Inventor: Thomas G. Carmichael, Tucson, AZ (US)

(73) Assignee: Samuel, Son & Co. (USA) Inc., Woodridge, IL (US)

( * ) Notice: Subject to any disclaimer, the term of this patent is extended or adjusted under 35 U.S.C. 154(b) by 998 days.

(21) Appl. No.: 16/713,630

(22) Filed: Dec. 13, 2019

Related U.S. Application Data

(60) Provisional application No. 62/783,876, filed on Dec. 21, 2018.

(51) Int. Cl.

| | |
|---|---|
| ***B08B 3/02*** | (2006.01) |
| ***B03C 3/78*** | (2006.01) |
| ***C25C 7/08*** | (2006.01) |
| ***B08B 13/00*** | (2006.01) |

(52) U.S. Cl.
CPC ..... *B03C 3/78* (2013.01); *B08B 3/024* (2013.01); *B08B 13/00* (2013.01); *C25C 7/08* (2013.01); *B08B 2203/007* (2013.01)

(58) Field of Classification Search
CPC .. C25C 7/08; B03C 3/78; B08B 13/00; B08B 3/024
See application file for complete search history.

(56) References Cited

U.S. PATENT DOCUMENTS 9,505,034 B2 * 11/2016 Jickling ..... B08B 3/022
2016/0060778 A1 * 3/2016 Kim ..... C25C 7/00 204/232

FOREIGN PATENT DOCUMENTS

KR 1879633 B1 * 7/2018 ..... C25C 7/007
WO WO-2007124605 A1 * 11/2007 ..... C25C 1/00

* cited by examiner

*Primary Examiner* — Tinsae B Ayalew
(74) *Attorney, Agent, or Firm* — Foley & Lardner LLP

(57) ABSTRACT

A system for washing a cathode comprises a frame configured to secure the cathode and a lifting assembly configured to transport the cathode in a substantially vertical direction. A spray head is coupled to the frame and is in fluid communication with a water supply such that the spray head sprays the cathode with water from the water supply. The washing system provides for washing both sides of a cathode simultaneously.

20 Claims, 6 Drawing Sheets

AUTOMATED CATHODE WASHING SYSTEM

CROSS-REFERENCE TO RELATED APPLICATIONS

The present application claims priority to U.S. Provisional Patent Application No. 62/783,876, entitled "Cathode Automated Washing System" and filed Dec. 21, 2018. The contents of this application are incorporated herein by reference.

TECHNICAL FIELD

The present invention relates to washing systems. More particularly, the present invention relates to systems for washing a cathode for an electro-winning system.

BACKGROUND

Electro-winning is a process, similar to electroplating, that uses an electric current to reduce dissolved metal cations to form a thin metal coating on a cathode. Electro-winning is used to change the surface properties of an object (such as abrasion and wear resistance, corrosion protection, lubricity, or aesthetic qualities), to increase the thickness of undersized parts, and to refine metals (such as copper, etc.) in the mining industry and related industries. Some conventional materials used for cathodes include copper, titanium, platinum, and steel. Effectively cleaning the cathode prior to buffing and/or electro-winning is important in order to remove surface debris and contamination such that the cathode can be properly plated. In one conventional cathode cleaning process, solvents such as carbonates, sodium metasilicate, surfactants, or synthetic detergents are used to clean the cathode. However, using solvents to clean the cathode can negatively impact the environment or the surface properties of the cathode such that the electro-winning process is less effective. An improved cathode washing process is required to effectively clean a cathode without the use of solvents.

SUMMARY

Various embodiments provide a cleaning system. The cleaning system comprises a frame configured to secure a cathode. The frame includes a lifting assembly defining a slot configured to secure the cathode. The lifting assembly is configured to move in a substantially vertical direction. An actuator is in communication with the lifting assembly. The actuator is configured to transport the lifting assembly in the substantially vertical direction. A first nozzle is rotationally coupled to a spray head cover. The spray head cover is movable relative to the frame. A water supply is in fluid communication with the first nozzle. A tank contains the water supply. The tank comprises a heating element configured to heat the water supply.

Additional embodiments provide a cleaning system. The cleaning system comprises a frame configured to secure a cathode. The frame includes a lifting assembly defining a strip guard configured to secure a bottom edge of the cathode and a first edge guard configured to secure a first vertical edge of the cathode. The strip guard and the first edge guard are configured to substantially prevent rotation of the cathode about a vertical axis and a horizontal axis. An actuator is in communication with the lifting assembly. The actuator is configured to transport the lifting assembly in a substantially vertical direction. A spray head assembly comprises a roller track movably coupled to a spray head cover, a manifold rotatably coupled to the spray head cover, and a first nozzle in fluid communication with the manifold. A linear drive is coupled to the spray head assembly. The linear drive is configured to move the spray head assembly in a substantially horizontal direction. A water supply is in fluid communication with the first nozzle. A tank contains the water supply. The tank comprises a heating element configured to heat the water supply. A high pressure pump is in fluid communication with the water supply. The high pressure pump is configured to pump heated water through the first nozzle so as to spray heated, pressurized water on the cathode to clean the cathode.

Further embodiments provide a cleaning system. The cleaning system includes a frame configured to secure a cathode. The frame includes a lifting assembly defining a slot configured to secure the cathode. The lifting assembly is configured to move in a substantially vertical direction. An actuator is in communication with the lifting assembly, and the actuator is configured to transport the lifting assembly in the substantially vertical direction. A first nozzle is rotationally coupled to a spray head cover, the spray head cover being movable relative to the frame. A water supply in fluid communication with the first nozzle, and a tank contains the water supply. The tank includes a storage side to contain clean water and a collection side to contain water previously used to clean the cathode.

These and other features, together with the organization and manner of operation thereof, will become apparent from the following detailed description when taken in conjunction with the accompanying drawings, wherein like elements have like numerals throughout the several drawings described below.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

DETAILED DESCRIPTION

Figure 1:
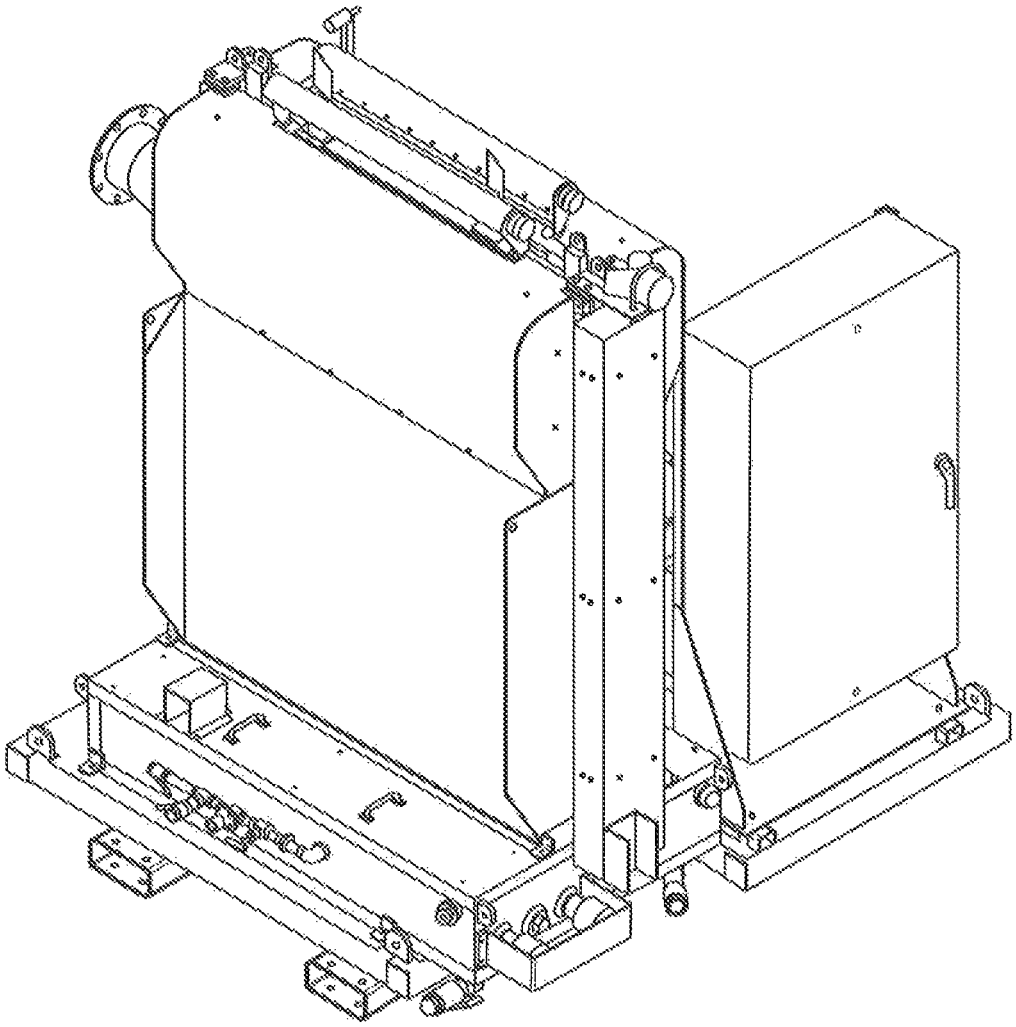
FIG. 1 is a perspective view of a washing system, according to a particular embodiment.
Figure 2:
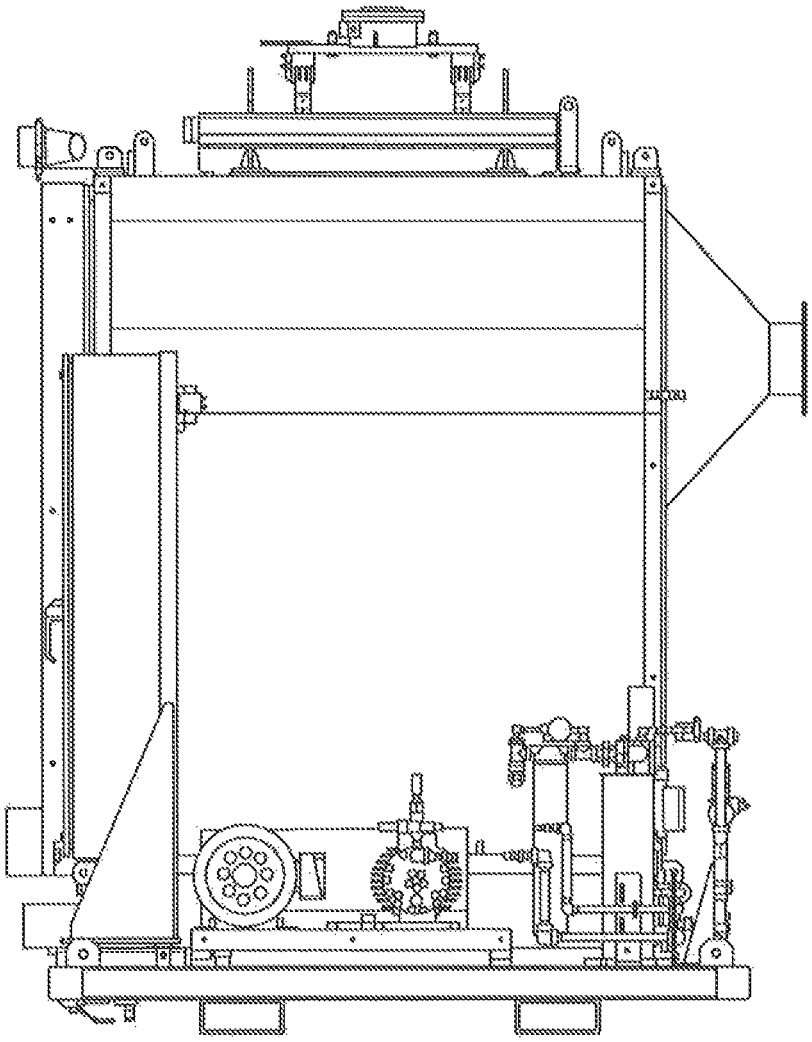
FIG. 2 is a back view of the washing system of FIG. 1.

FIGS. 1-2 show perspective and back views, respectively, of a washing system 100, according to a particular embodiment. The washing system 100 may be used when washing a cathode to prepare for buffing or an electro-winning process. The washing system 100 includes a frame 102, a tank 104, a demister connection 106, a first lower cover 108, a control box 110, a slot 112, a first upper cover 114, a high pressure pump 202, a second lower cover 204, and a second upper cover 206.

The frame 102 may be constructed of, for example, metallic materials such as stainless steel, aluminum, or other metals suitable for manufacturing. The choice of material may depend on the particular manufacturing environment. The frame 102 is configured to support the internal structures of the washing system 100 which will be described with reference to FIGS. 5-7. The frame 102 is releasably coupled to the tank 104 such that the tank 104 can be removed from the frame 102. The frame 102 defines the slot 112, which is sized and configured to receive a cathode for a cathode washing process.

The tank 104 is releasably coupled to the frame 102 and may be constructed of, for example, metallic materials such as stainless steel, aluminum, or other metals suitable for manufacturing. The tank 104 is configured to receive and store a cleaning fluid (e.g., water) for use by the washing system 100, and is also configured to receive the used cleaning fluid after the washing process is complete. The tank 104 will be further described with reference to FIG. 3.

The demister connection 106 is rigidly coupled to the frame 102 and may be constructed of for example, metallic materials such as stainless steel, aluminum, or other metals suitable for manufacturing. The demister connection 106 is configured to connect to a demister 400 that removes water vapor from the washing system 100. The demister connection 106 may be threaded, riveted, quick-connect, or any other type of connection that can provide a secure connection to a demister.

The first lower cover 108 and the second lower cover 204 are releasably coupled to the frame 102 and may be constructed of for example, metallic materials such as stainless steel, aluminum, or other metals suitable for manufacturing. The first lower cover 108 and the second lower cover 204 are configured to substantially enclose the lower internal structures of the washing system 100 when the washing system 100 is operating. Enclosing the washing system 100 during operation prevents injuries and prevents debris and fluid from escaping the washing system 100. When the first lower cover 108 and the second lower cover 204 are removed, access to the lower interior of the washing system 100 is provided such that repairs or regular maintenance activities can be conducted.

The first upper cover 114 and the second upper cover 206 are releasably coupled to the frame 102 and may be constructed of for example, metallic materials such as stainless steel, aluminum, or other metals suitable for manufacturing. The first upper cover 114 and the second upper cover 206 are configured to substantially enclose the upper internal structures of the washing system 100 when the washing system 100 is operating. Enclosing the washing system 100 during operation prevents injuries and prevents debris and fluid from escaping the washing system 100. When the first upper cover 114 and second upper cover 206 are removed, access to the upper interior of the washing system 100 is provided such that repairs or regular maintenance activities can be conducted.

The control box 110 is electrically coupled to the frame 102 and is configured to control the washing system 100. The control box 110 is in electrical communication with any electrical equipment included in the washing system 100, and is configured to receive and send electrical signals to the washing system 100.

The high pressure pump 202 is fluidly coupled to the tank 104 and is configured to provide cleaning fluid (e.g., water) at a high pressure to the washing system 100. As used herein, the term "high pressure" is defined as a fluid pressure equal to, or greater than, 1500 pounds per square inch (PSI). The high pressure pump 202 may be a positive displacement pump, a gear pump, a screw pump, or any other type of pump configured to provide cleaning fluid to the washing system 100 at a high pressure.

Figure 3:
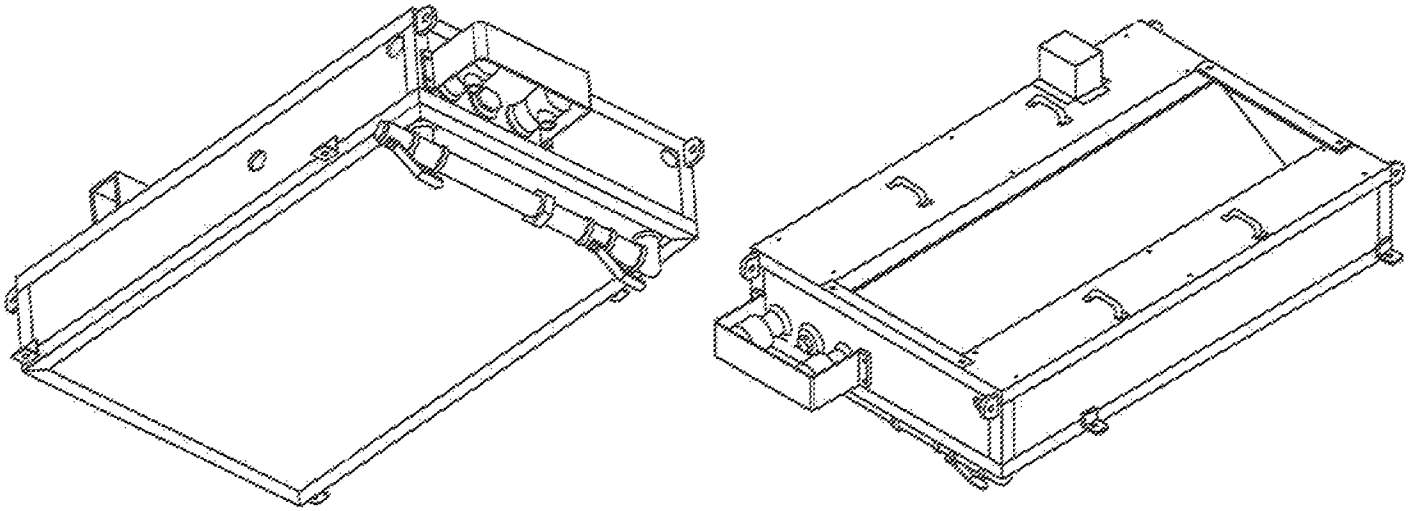
FIG. 3 is a perspective view of a tank of the washing system of FIG. 1.

FIG. 3 is a perspective view of the tank 104 of the washing system 100 of FIG. 1. The tank 104 includes a drain 302, a drain 304, a heating element 306, a storage side 308, a collection side 310, a sensor housing 312, an inlet 314, and a ramp 316.

In some embodiments, the storage side 308 is configured to receive clean water from a water source. In other embodiments, the storage side 308 is configured to receive recycled water from the collection side 310 to be used for cleaning a cathode. The clean water is configured to enter the storage side 308 via the inlet 314, which is in fluid communication with the clean water source. The drain 302 is in fluid communication with the storage side 308 such that the water held within the storage side 308 can be drained, if needed.

The heating element 306 is releasably coupled to the storage side 308 and is configured to heat the clean water prior to the clean water being used to clean a cathode in the washing system 100. The heating element 306 may be electrical, gas, tube or any other type of thermal device capable of heating the water. The heating element 306 may be metal, polymer, composite, or any other type of heating element capable of heating the clean water on the storage side 308. As used herein, the term "hot water" is defined as water that reaches a temperature equal to, or greater than, one hundred fifty degrees Fahrenheit (F).

The sensor housing 312 is rigidly coupled to the storage side 308 and is configured to enclose various sensors such as a water level sensor and a temperature sensor. The water level sensor is configured to sense how much water is present in the storage side 308 and provide information on the amount of water to the control box 110. The water level sensor can be a float sensor, a magnetic sensor, a conductive sensor, or any other type of level sensor that can sense the level of water in the storage side 308. The temperature sensor is configured to sense the temperature of the water in the storage side 308 and provide the temperature information to the control box 110. The temperature sensor can be a thermometer, a thermocouple, or any other type of sensor that can sense the temperature of the water in the storage side 308.

The collection side 310 is configured to receive water from the washing system 100 after the water has been used to clean a cathode. The used water is configured to enter the collection side 310 via the ramp 316, which is angled to direct the used water into the collection side 310. The drain 304 is in fluid communication with the collection side 310 such that the used water held within the collection side 310 can be drained after the washing system 100 has completed a washing cycle. In some implementations, the water can be tested to determine its suitability for use in future washing cycles and can be reused if it is determined to be suitable. In other implementations, the water can be drained from the collection side 310 if the water is determined to be unusable after one or more washing cycles.

Figure 4:
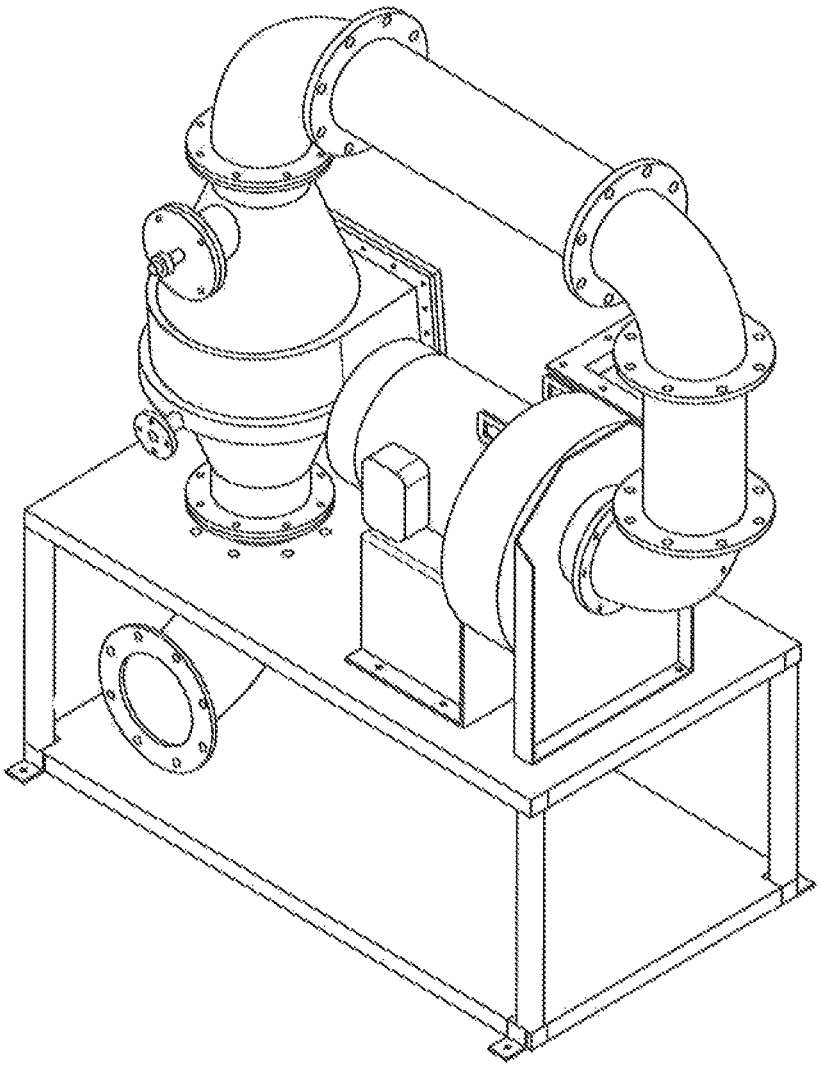
FIG. 4 is a perspective view of a demister, according to a particular embodiment.

FIG. 4 is a perspective view of a demister 400, according to a particular embodiment. The demister 400 is configured to receive an air-water vapor mixture from the washing system 100 and separate the water from the air, returning the water to the washing system 100 and pulling the air through an exhaust system. The demister 400 includes a demister connection 402, a tank return 404, a moisture extractor 406, piping 408, an exhaust fan 410, and an exhaust 412.

The demister connection 402 may be constructed of, for example, metallic materials such as stainless steel, aluminum, or other metals suitable for manufacturing. The demister connection 402 may also be constructed of, for example, plastic materials such as polycarbonate, ABS, or other plastics suitable for manufacturing. The demister connection 402 is configured to connect to the demister connection 106 such that the demister 400 is in fluid communication with the washing system 100. The demister connection 402 may be threaded, riveted, quick-connect, or any other type of connection that can provide a secure connection to the demister connection 106.

The tank return 404 is in fluid communication with the tank 104 and is configured to return water to the tank 104 after the water has been separated from the air by the demister 400. The tank return 404 may be constructed of, for example, metallic materials such as stainless steel, aluminum, or other metals suitable for manufacturing. The tank return 404 may also be constructed of, for example, plastic materials such as polycarbonate, ABS, or other plastics suitable for manufacturing. In some embodiments, the tank return 404 can return the water to the storage side 308 to be used in the cleaning process. In other embodiments, the tank return 404 can return the water to the collection side 310 to be drained with the water used in the cleaning process.

The moisture extractor 406 is configured to receive the air-water vapor mixture from the washing system 100 and separate the air from the water. The moisture extractor 406 may be any conventional device that can aggregate the water vapor into droplets heavy enough to separate from the air and fall, via gravity, to the tank return 404. The air, after separation from the water, will continue to rise in the demister 400.

The piping 408 is rigidly coupled to the moisture extractor 406 and is configured to direct the air toward the exhaust fan 410 after the air is separated from the water. The piping 408 may be constructed of, for example, metallic materials such as stainless steel, aluminum, or any other metals suitable for manufacturing. The piping 408 may also be constructed of, for example, plastic materials such as polycarbonate, ABS, or other plastics suitable for manufacturing.

The exhaust fan 410 is rigidly coupled to the piping 408 and the exhaust 412 and is configured to direct the air from the piping 408 through the exhaust 412. The exhaust fan may be any type of device capable of directing air from the piping 408 and through the exhaust 412. The exhaust 412 may release the air directly into the surrounding environment, or it may be further coupled to exhaust ducting or a HVAC system to circulate the air or direct the air in any other way.

Figure 5:
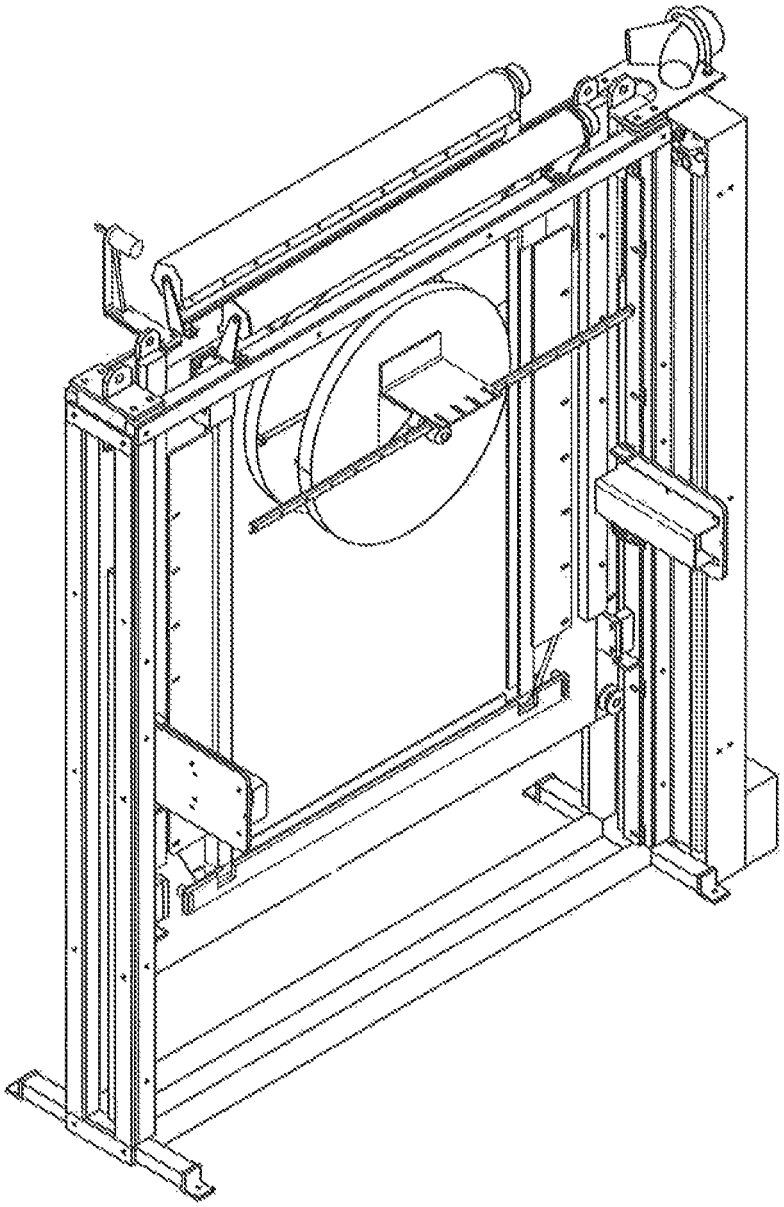
FIG. 5 is a perspective view of a frame of the washing system of FIG. 1.

FIG. 5 is a perspective view of the frame 102 of the washing system 100 of FIG. 1. The frame 102 includes a sensor 502, dryers 504, a spray head 508, a roller track 506, a lifting assembly 510, a first rail assembly 518, and a second rail assembly 520, and an actuator 536.

The sensor 502 is rigidly coupled to the frame 102 and is in electrical communication with the control box 110. The sensor 502 is configured to determine whether a cathode is present in the washing system 100 and provide information about the presence of a cathode to the control box 110. The sensor 502 may be an optical sensor, a force sensor, or any other sensor that may be configured to detect the presence of a cathode in the washing system 100.

The dryers 504 are rigidly coupled to the frame 102 and are in electrical communication with the control box 110. The dryers 504 are configured to direct air over a cathode as the cathode is removed from the washing system 100 to remove any remaining liquid on the outer surface of the cathode from the washing process. The dryers 504 can be air knives, compressed air blowers, or any other type of device capable of removing liquid from a cathode as it is removed from the washing system 100.

The spray head 508 is movably coupled to the frame 102 and the roller track 506. The spray head 508 is also in fluid communication with the tank 104. The spray head 508 is configured to receive hot pressurized water from the storage side 308 of the tank 104 and spray the hot water on a cathode within the washing system 100. The spray head 508 will be further described with reference to FIG. 7.

The roller track 506 is movably coupled to the spray head 508 and is rigidly coupled to a linear drive mechanism. The roller track 506 is configured to move the spray head 508 linearly in a substantially horizontal direction (e.g., plus or minus five degrees of true horizontal) such that the spray head 508 can effectively clean the entire width of a cathode. The roller track 506 may be any type of device configured to couple with a linear drive or actuator to provide for linear motion.

The lifting assembly 510 is movably coupled to the first rail assembly 518 and the second rail assembly 520 and is configured to move a cathode in a substantially vertical (e.g., plus or minus five percent) direction. The lifting assembly 510 further includes strip guards 512, edge guards 514, rails 522, lower rollers 524, shelves 528, and an actuator slot 538.

The strip guards 512 are sized and configured to receive a cathode and maintain the cathode in a substantially vertical orientation. The strip guards 512 define a space configured to receive the bottom edge of the cathode such that the cathode is prevented from rotation about a horizontal axis.

The edge guards 514 are sized and configured to receive a cathode and maintain the cathode in a substantially vertical orientation. The edge guards 514 define a space configured to receive the vertical edges of the cathode such that the cathode is prevented from rotation about a vertical axis.

The rails 522 are sized and configured to be linearly coupled to the lower rollers 524, located on the first rail assembly 518 and the second rail assembly 520, respectively. As the lifting assembly 510 moves in a substantially vertical direction, the lower rollers 524 rotate as the rails 522 move with the lifting assembly 510. The lower rollers 524 are also sized and configured to maintain the lifting assembly 510 in a substantially vertical orientation.

The lower rollers 524 are sized and configured to be linearly coupled to the rails 526 such that, as the lifting assembly 510 moves in a substantially vertical direction, the lower rollers 524 rotate along the rails 526 as the lifting assembly 510 moves.

The shelves 528 are sized and configured to receive a cathode header bar that is attached to a cathode and maintain the cathode in a substantially vertical orientation. The shelves 528 define a space configured to receive the cathode header bar such that the cathode header bar, and therefore the cathode, is prevented from rotation about a horizontal axis.

The actuator slot 538 is a cutout in the lifting assembly 510 that is sized and configured to fit around the actuator 536 such that movement of the actuator 536 results in movement of the lifting assembly 510.

The first rail assembly 518 and the second rail assembly 520 are rigidly coupled to the frame 102 and are configured to support the lifting assembly 510. The first rail assembly 518 further includes a stop 516, a rail 526, and an upper roller (not shown). The second rail assembly 520 further includes a stop 516, a rail 526, an upper roller, and an actuator 536. In the embodiment shown in FIG. 5, the first rail assembly 518 and the second rail assembly 520 are substantially identical, with the only difference being the first rail assembly does not include an actuator.

The stops 516 are rigidly coupled to the first rail assembly 518 and the second rail assembly 520 and are configured to set a fixed position and to prevent the lifting assembly 510 from an uncontrolled fall in case of a failure of the washing system 100.

The rails 522 and the rails 526 are sized and configured to engage with the lower rollers 524 and the upper rollers included in both the first rail assembly 518 and the second rail assembly 520 to provide for the substantially vertical travel of the lifting assembly 510.

The actuator 536 is linearly coupled to the second rail assembly 520 and is configured to move in a substantially vertical direction. The actuator 536 is also configured engage with the actuator slot 538 such that when the actuator 536 moves in a substantially vertical direction, the actuator slot 538, and thus the lifting assembly 510, also moves in a substantially vertical direction.

Figure 6:
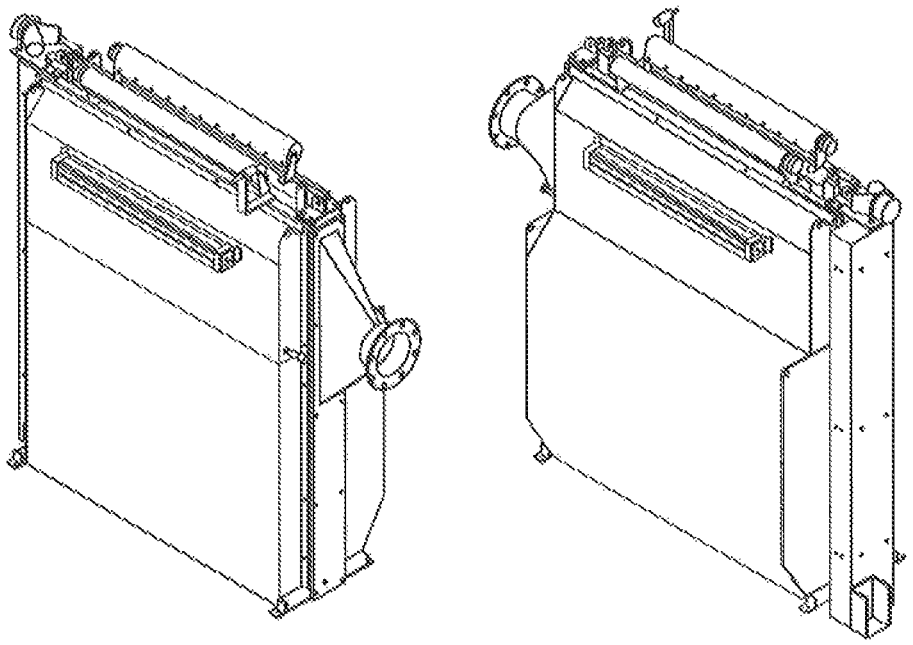
FIG. 6 shows multiple perspective views of the frame of FIG. 5.

FIG. 6 is a perspective view of the frame 102 of FIG. 5. The frame further includes a first linear drive 604, a second linear drive 602, a first upper shell 610, and a second upper shell 606.

The first upper shell 610 and the second upper shell 606 are releasably coupled to the frame 102 and are configured to cover the upper internal components of the washing system 100. The first upper shell 610 is rigidly coupled to the first linear drive 604, and the second upper shell 606 is rigidly coupled to the second linear drive 602. The first upper shell 610 and the second upper shell 606 include slots such that the second linear drive 602 and the first linear drive 604 can be in communication with the roller tracks 506. The first upper shell 610 and the second upper shell 606 may be constructed of, for example, metallic materials such as stainless steel, aluminum, or other metals suitable for manufacturing.

The first linear drive 604 is rigidly coupled to the first upper shell 610, and the second linear drive 602 is rigidly coupled to the second upper shell 606. The first linear drive 604 and the second linear drive 602 are linearly coupled to the roller tracks 506. The first linear drive 604 and the second linear drive 602 are configured to move the roller tracks 506, and thus the spray heads 508, in a substantially horizontal direction such that the spray heads 508 can reach the entire width of a cathode being washed in the washing system 100.

Figure 7:
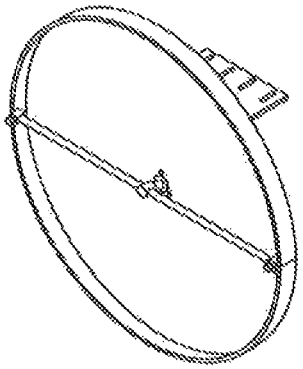
FIG. 7 is a perspective view of a spray head of the washing system of FIG. 1.

FIG. 7 is a perspective view of a spray head 508 of the washing system 100 of FIG. 1. The spray head 508 is configured to spray hot, pressurized water on a cathode during the washing process to clean the cathode. The spray head 508 includes nozzles 702, a rotating manifold 704, a spray head cover 706, a rotor 708, and bracket 710.

The nozzles 702 are rigidly coupled to the rotating manifold 704 and are configured to spray hot, pressurized water on to a cathode within the washing system 100. As shown, two nozzles 702 are located within the spray head 508, however any number of nozzles 702 can be used. The nozzles 702 can be a spray nozzle, a high velocity nozzle, or any other type of nozzle that is capable of spraying hot, pressurized water on a cathode.

The rotating manifold 704 is rotatably coupled to the rotor 708 such that the rotating manifold 704 can freely rotate via the rotor 708. The rotor 708 is rigidly coupled to the spray head cover 706 and the bracket 710, and the bracket 710 is linearly coupled to the roller track 506. As the roller track 506 moves the bracket 710, and thus the spray head 508, moves with the roller track 506.

Throughout the description above, many elements were described as singular elements, however, as shown in FIG. 5, it will be understood that the washing system 100 includes two sides such that a cathode can be washed on two sides at the same time. Thus, in instances in which only a single element was described above, it will be understood that more than one element may be present in the washing system 100.

In operation, and with reference to FIGS. 1-7, a cathode must be washed prior to being buffed and/or used in an electro-winning process. A cathode generally includes a sheet and a header bar coupled to the sheet. The sheet may be any metal suitable for an electro-winning process (e.g., copper, zinc, platinum, etc.). The header bar is an attachment that facilitates cathode cleaning, buffing, and/or electro-winning processes by allowing the cleaning, buffing, and/or electro-winning equipment to manipulate the cathode sheet without contacting the cathode sheet with unwanted materials. To properly wash the cathode using the washing system 100, the cathode is lowered through the slot 112 until the cathode header bar contacts the shelves 528. In some implementations, a user will lower the cathode into the slot 112. In other implementations, a robot or other automated process will lower the cathode into the slot 112.

As the cathode is lowered into the slot 112, the outer edges of the cathode are within the edge guards 514. When the cathode has been fully lowered into the slot 112 and the cathode header bar is resting on the shelves 528, the lower edge of the cathode is located within the strip guard 512. Placed into the washing system 100 as described, the cathode is held in a substantially vertical orientation and is prevented from substantially rotating in any direction. The sensor 502 will recognize that a cathode is in position to be cleaned and will send a signal to the control box 110 that the cathode is ready for the washing process to begin.

Prior to initiating the washing process, there must be hot water in the storage side 308 of the tank 104. In some embodiments, the storage side 308 can be filled with water from an external water source. In such instances, it may be necessary to filter the water before filling the storage side 308 to remove impurities that could damage the cathode during the washing process. In some implementations, the water must pass through a five-hundred micron filter. In a particular implementation, the water must pass through a twenty-micron filter. In some variations, the storage side 308 can be filled with water extracted by the demister 400. In such variations, it may not be necessary to filter the water extracted by the demister 400 because the water may have been previously filtered prior to entering the washing system 100.

After the storage side 308 is filled with water, the water must be heated to the appropriate temperature for the washing process by the heating element 306. In some embodiments, the water must reach at least one hundred fifty degrees Fahrenheit. In a particular embodiment, the water must reach at least two hundred degrees Fahrenheit. The sensors within the sensor housing 312 will monitor the temperature of the water and the water level and communicate with the control box 110. When the water is the appropriate temperature and at the appropriate level to begin the washing process, the sensors will send a signal to the control box 110 to notify the control box 110 that the water is ready for the washing process to begin.

After the control box 110 receives signals that a cathode is present in the washing system 100 and the water is at the appropriate level and temperature, the washing process can begin. In some embodiments, to initiate the washing process a user will actuate a button. In other embodiments, the washing process will be initiated automatically when the sensors indicate that all conditions have been met to begin the washing process.

When the washing process begins, the control box 110 sends electrical signals to the high pressure pump 202, the linear drives 602-604, the actuator 536, and the demister 400 that the washing process should begin.

The high pressure pump 202 pumps the hot water from the storage side 308 through the nozzles 702 such that the hot water contacts the cathode at a high pressure. In some implementations, the water exits the nozzles 702 at a pressure of at least 1500 PSI. In a particular implementation, the water exits the nozzles 702 at a pressure of at least 2200 PSI.

In some embodiments, the nozzles 702 are configured to eject the hot water at an angle (e.g., not perpendicular) to the cathode such that the force of the water exiting the nozzles 702 causes the rotating manifold 704, and thus the nozzles 702, to rotate around the rotor 708. For example, one nozzle 702 may be directed at a positive 30-degree angle to the cathode and the other nozzle 702 may be directed at a negative 30-degree angle to the cathode to induce the rotational motion.

The linear drives 602-604 cause the roller tracks 506 to move the brackets 710, and therefore the spray heads 508, in a horizontal direction (e.g., side-to-side) such that the nozzles 702 can reach the outer edges of the cathode and clean the entire width of both sides of the cathode.

As the washing process continues, the actuator 536 moves in the vertical direction. As the actuator 536 moves in the vertical direction, the actuator 536 contacts the actuator slot 538 located on the lifting assembly 510 such that, as the actuator 536 moves the lifting assembly 510 also moves. Thus, as the actuator 536 moves up and down in the vertical direction, the lifting assembly 510 moves up and down in the vertical direction and causes the nozzles 702 to clean the entire length of both sides of the cathode.

Throughout the washing process, water sprayed from the nozzles 702 may eventually contact the ramp 316 and be directed into the collection side 310. In some variations, the water collected on the collection side 310 will be discarded after the washing process is complete. In other variations, the water collected on the collection side 310 may be reused after passing over separation baffles in the tank.

Water sprayed from the nozzles 702 may also create a mist of air and water vapor that does not collect in the collection side 310. The demister 400 pulls the mist from the washing system 100 such that the mist passes through the moisture extractor 406, where the water is separated from the air. The water collects in the tank return 404, and the air is pulled through the exhaust fan 410 and out the exhaust 412. In some embodiments, the water collected in the tank return 404 is returned directly to the storage side 308 of the tank 104. In a particular embodiment, the water collected in the tank return 404 is returned to the storage side 308 after passing through the appropriate filters.

When the washing process is complete, the cathode is removed from the slot 112 by a user, in some implementations. In other implementations, the cathode is removed from the slot 112 by a robot or other automated process. As the cathode is removed from the slot 112, the dryers 504 direct pressurized air at the cathode to remove any remaining water or debris from the cathode. The pressurized air is directed downward such that any other water or debris is collected by the collection side 310 of the tank 104.

As utilized herein, the terms "substantially" and similar terms are intended to have a broad meaning in harmony with the common and accepted usage by those of ordinary skill in the art to which the subject matter of this disclosure pertains. It should be understood by those of ordinary skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

References herein to the positions of elements (e.g., "top," "bottom," "upper," "above," "below," etc.) are merely used to describe the orientation of various elements in the Figures. It should be noted that the orientation of various elements may differ according to other exemplary embodiments, and that such variations are intended to be encompassed by the present disclosure.

Although only a few embodiments have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter described herein. For example, elements shown as integrally formed may be constructed of multiple components or elements, the position of elements may be reversed or otherwise varied, and the nature or number of discrete elements or positions may be altered or varied. The order or sequence of any method processes may be varied or resequenced according to alternative embodiments. Other substitutions, modifications, changes, and omissions may also be made in the design, operating conditions and arrangement of the various exemplary embodiments without departing from the scope of the present invention.

What is claimed is:

1. A cleaning system, comprising:

a frame configured to secure a cathode, comprising:

a lifting assembly defining a slot configured to secure the cathode, the lifting assembly further configured to move in a vertical direction and prevent rotation of the cathode about a vertical axis and a horizontal axis;

an actuator in communication with the lifting assembly, the actuator configured to transport the lifting assembly in the vertical direction;

a first nozzle rotationally coupled to a spray head cover, the spray head cover movable relative to the frame;

a water supply in fluid communication with the first nozzle; and a tank to contain the water supply, the tank comprising a heating element configured to heat the water supply.

2. The system of claim 1, further comprising a demister coupled to the frame, the demister configured to remove water vapor from the system.

3. The system of claim 1, further comprising a dryer coupled to the frame, the dryer configured to remove water from an outer surface of the cathode as the cathode is removed from the frame.

4. The system of claim 1, further comprising a high pressure pump in fluid communication with the water supply, the high pressure pump configured to pump heated water through the first nozzle so as to spray heated, pressurized water on the cathode to clean the cathode as the cathode moves in the vertical direction.

5. The system of claim 4, further comprising:

an upper cover releasably coupled to the frame, the upper cover configured to enclose the spray head cover;

a roller track movably coupled to the spray head cover; and a linear drive coupled to the upper cover and to the roller track, the linear drive configured cause the roller track to move the spray head cover in a horizontal direction.

6. The system of claim 5, further comprising:

a bracket coupled to the spray head cover, the bracket movably coupled to the roller track;

a rotor coupled to the spray head cover; and a manifold rotatably coupled to the rotor, the manifold in fluid communication with the water supply, the manifold configured to rotate relative to the spray head cover.

7. The system of claim 6, wherein the first nozzle is positioned at a first end of the manifold, the first nozzle in fluid communication with the manifold, and further comprising:

a second nozzle positioned at a second end of the manifold, the second nozzle in fluid communication with the manifold;

wherein the first nozzle is configured to spray water at a first angle, the second nozzle is configured to spray water at a second angle, and the manifold is configured to rotate in response to water being sprayed at the first angle and the second angle.

8. A cleaning system comprising:

a frame configured to secure a cathode, the frame comprising:

a lifting assembly defining a strip guard configured to secure a bottom edge of the cathode and a first edge guard configured to secure a first vertical edge of the cathode, the strip guard and the first edge guard configured to prevent rotation of the cathode about a vertical axis and a horizontal axis; and an actuator in communication with the lifting assembly, the actuator configured to transport the lifting assembly in a vertical direction;

a spray head assembly comprising:

a roller track movably coupled to a spray head cover;

a manifold rotatably coupled to the spray head cover; and a first nozzle in fluid communication with the manifold;

a linear drive coupled to the spray head assembly, the linear drive configured to move the spray head assembly in a horizontal direction;

a water supply in fluid communication with the first nozzle;

a tank to contain the water supply, the tank comprising a heating element configured to heat the water supply; and a high pressure pump in fluid communication with the water supply, the high pressure pump configured to pump heated water through the first nozzle so as to spray heated, pressurized water on the cathode to clean the cathode.

9. The system of claim 8, further comprising a shelf coupled to the frame, the shelf configured to support a header bar coupled to the cathode.

10. The system of claim 9, wherein the frame defines a slot configured to receive the header bar.

11. The system of claim 8, further comprising a sensor coupled to the frame, the sensor configured to determine a presence of a cathode within the frame.

12. The system of claim 8, further comprising a dryer coupled to the frame, the dryer configured to remove water from an outer surface of the cathode as the cathode is removed from the frame.

13. The system of claim 8, further comprising:

a first rail positioned on a first side of the lifting assembly, the first rail comprising first lower rollers and first upper rollers, the first lower rollers and first upper rollers linearly coupled to the first side of the lifting assembly; and a second rail positioned on a second side of the lifting assembly, the second rail comprising second lower rollers and second upper rollers, the second lower rollers and second upper rollers linearly coupled to the second side of the lifting assembly.

14. The system of claim 13, further comprising:

a first rail assembly coupled to the first rail;

a second rail assembly coupled to the second rail; and a stop coupled to the first rail or the second rail, the stop configured to prevent an uncontrolled fall of the lifting assembly.

15. The system of claim 14, further comprising a first upper cover removably coupled to the frame, the first upper cover coupled to the linear drive and configured to cover the spray head assembly.

16. A cleaning system, comprising:

a frame configured to secure a cathode, comprising:

a lifting assembly defining a slot configured to secure the cathode, the lifting assembly configured to move in a vertical direction and prevent rotation of the cathode about a vertical axis and a horizontal axis; and an actuator in communication with the lifting assembly, the actuator configured to transport the lifting assembly in the vertical direction;

a first nozzle rotationally coupled to a spray head cover, the spray head cover movable relative to the frame;

a water supply in fluid communication with the first nozzle; and a tank to contain the water supply, the tank comprising:

a storage side to contain clean water; and a collection side to contain water previously used to clean the cathode.

17. The cleaning system of claim 16, further comprising a heating element coupled to the storage side of the tank, the heating element configured to heat the clean water.

18. The cleaning system of claim 16, further comprising a ramp positioned between the storage side and the collection side, the ramp configured to direct the water previously used to clean the cathode to the collection side.

19. The cleaning system of claim 16, further comprising a sensor housing coupled to the storage side of the tank, the sensor housing configured to enclose one or more sensors.

20. The cleaning system of claim 16, further comprising an inlet in fluid communication with the storage side of the tank, the inlet configured to provide water to the storage side of the tank from a clean water source or the collection side of the tank.

* * * * *